US011148865B2

(12) United States Patent
Nelson

(10) Patent No.: US 11,148,865 B2
(45) Date of Patent: Oct. 19, 2021

(54) INFLATABLE PACKAGING DEVICE

(71) Applicant: Nikeisha Nelson, Brooklyn, NY (US)

(72) Inventor: Nikeisha Nelson, Brooklyn, NY (US)

( * ) Notice: Subject to any disclaimer, the term of this patent is extended or adjusted under 35 U.S.C. 154(b) by 294 days.

(21) Appl. No.: 16/138,195

(22) Filed: Sep. 21, 2018

(65) Prior Publication Data

US 2020/0024052 A1 Jan. 23, 2020

Related U.S. Application Data

(60) Provisional application No. 62/700,758, filed on Jul. 19, 2018.

(51) Int. Cl.

| | |
|---|---|
| ***B65D 65/16*** | (2006.01) |
| ***B65D 81/05*** | (2006.01) |
| ***A43D 3/14*** | (2006.01) |
| ***B65D 85/18*** | (2006.01) |

(52) U.S. Cl.

CPC ..... *B65D 81/052* (2013.01); *A43D 3/14* (2013.01); *B65D 65/16* (2013.01); *B65D 85/187* (2013.01)

(58) Field of Classification Search

CPC ..... A47D 3/34; B65D 85/187; B65D 81/052; B65D 65/16; A45C 3/12

USPC ..... 206/280, 293, 522; 383/3

See application file for complete search history.

(56) References Cited

U.S. PATENT DOCUMENTS

| | | | | | |
|---|---|---|---|---|---|
| 3,351,184 | A * | 11/1967 | Spinks | B65D 85/187 | 206/296 |
| 3,891,082 | A * | 6/1975 | Fall | B65D 85/18 | 206/8 |
| 4,044,867 | A * | 8/1977 | Fisher | A45C 7/004 | 190/107 |
| 5,414,975 | A * | 5/1995 | Hummel | B65D 85/187 | 53/432 |
| 8,366,594 | B2 * | 2/2013 | Zhang | B65D 81/03 | 493/189 |
| 2003/0155268 | A1 * | 8/2003 | Wang | A45C 3/001 | 206/522 |
| 2011/0073520 | A1 * | 3/2011 | Okuma | B65D 81/113 | 206/590 |
| 2016/0137383 | A1 * | 5/2016 | Wetsch | B65D 81/263 | 206/522 |
| 2017/0071292 | A1 * | 3/2017 | Wetsch | A43B 17/03 | |

* cited by examiner

*Primary Examiner* — Sue A Weaver
(74) *Attorney, Agent, or Firm* — Erickson Law Group, PC

(57) ABSTRACT

Packaging is provided that inflates within the interior and exterior of a desired article, such as a pair of shoes. The pack is sized to the article's height, width, depth and in the case of shoes, has two distinct inserts that fit inside each one of a pair of shoes. When the package is inflated, both the interior and exterior of the shoes are cushioned and supported for shipment and storage. This invention allows the user to deflate the packaging, fold it to a reduced size, and either store the packaging or mail it back to the manufacturer to be repurposed for a continued life cycle.

18 Claims, 11 Drawing Sheets

INFLATABLE PACKAGING DEVICE

This application claims the benefit of U.S. Provisional Application No. 62/700,758, filed Jul. 19, 2018.

BACKGROUND

Shoes are typically shipped in cardboard shoe boxes. These cardboard boxes are typically stacked during shipment, which can constitute an extended period of time, especially for shoes imported from outside the United States. Stacking of the shoe boxes can result in compression of the shoes within the boxes. Shoes that are compressed for an extended period can retain the compressed shape, making the shoes unattractive for sale.

A common method of preventing compression is to stuff the inside of the shoes with paper or other "stuffing." Most existing cardboard packaging uses paper-based material, including the stuffing, which adds to the weight and cost of transport.

On the whole, current packaging are incompatible with current and ever-increasing environmental concerns. Paper forms of packaging use a percentage of virgin tree pulp due to down-cycling, which contributes to deforestation. Essentially, current packaging is intended to be discarded after use. The cumulative effect of discarding packaging material can ultimately extend and overwhelm landfills. Presently there is no cost-effective, eco-friendly packaging solution for footwear packaging, which provides effective protection for shoes and encourages the user to participate in the reuse of the packaging.

One attempt at using inflatable shoe stuffing is disclosed in U.S. Pat. No. 5,414,975, which reports using inflating bladders inside of shoes to support shoe structure during shipment. This construction, however, does not inflate a bladder on the exterior of the shoe within the packaging. Other attempts are disclosed in U.S. Pat. No. 6,971,135 and U.S. Patent application 2017/0071292. These documents describe approaches to inflate a volume on the interior of the shoe, however, these publications do not disclose an inflation volume external to the shoe.

The present inventor recognizes the need for a packaging device that is reusable, that is lightweight, and that effectively protects shoes from compression and external damage.

SUMMARY

This exemplary embodiment of the invention is an inflatable device that cushions and supports footwear internally and externally during shipment, storage and conveyance by a user. Moreover, the device is designed to be reused. The user may be encouraged to deflate and mail back the device to the shipper for reuse. This device promotes a new association with packaging, representing a closed model of repurposing existing packaging material as opposed to discarding the packaging material.

The exemplary embodiment of the invention improves packaging for goods which require protection from unwanted dust, liquid, external compression and impact during storage, transport, and conveyance by the customer. Aside from the advantage of the exemplary embodiment of the invention for shoes, especially the type with a fully constructed upper and connected sole (athletic/recreational shoes, dress shoes, boots, heels, and select sandals) there are many other products for which this distinctive packaging applies.

The disclosed embodiment includes a packaging device that comprises a flexible pack that surrounds the desired object in length, width/depth, and height. When inflated, this pack provides cushioning and protection from undesired external effects such as impact, compression, dust, liquid, rain, sunlight, and/or wind during storage and transport. The pack is shipped in flattened form and inflated at a later point to hold and protect the desired object. One or more air valves on the pack allow for its inflation and deflation.

The pack can include a handle and/or a permanent or attachable and removable strap system for carrying the pack by the end user.

The pack can include a small reinforced hangtag for hanging the pack in a closet or n storage.

The pack can have printed graphics on the surface thereof denoting branding and/or instructions, labeling, and/or to add aesthetic value.

The pack can have a pocket on the interior or exterior hereof for holding additional objects.

The pack can be composed of a flexible material that is made rugged and reinforced for more durability and protection for transport and storage. The flexible material can be made clear for easy visibility of the desired object inside the pack.

The pack can have an attached flap which covers the height of the pack and forms a pocket having an open interior where a thicker and sturdier material can be slipped into and out of the pocket, serving as a reinforced cover for the pack.

Numerous other advantages and features of the present invention will become readily apparent from the following detailed description of the invention and the embodiments thereof, from the claims and from the accompanying drawings.

BRIEF DESCRIPTION OF THE DRAWINGS

The accompanying drawings, which are incorporated in, and form a part of the specification, illustrate the components of the present invention and together with the description, serve to explain its operational principles.

DETAILED DESCRIPTION

Figure 1:
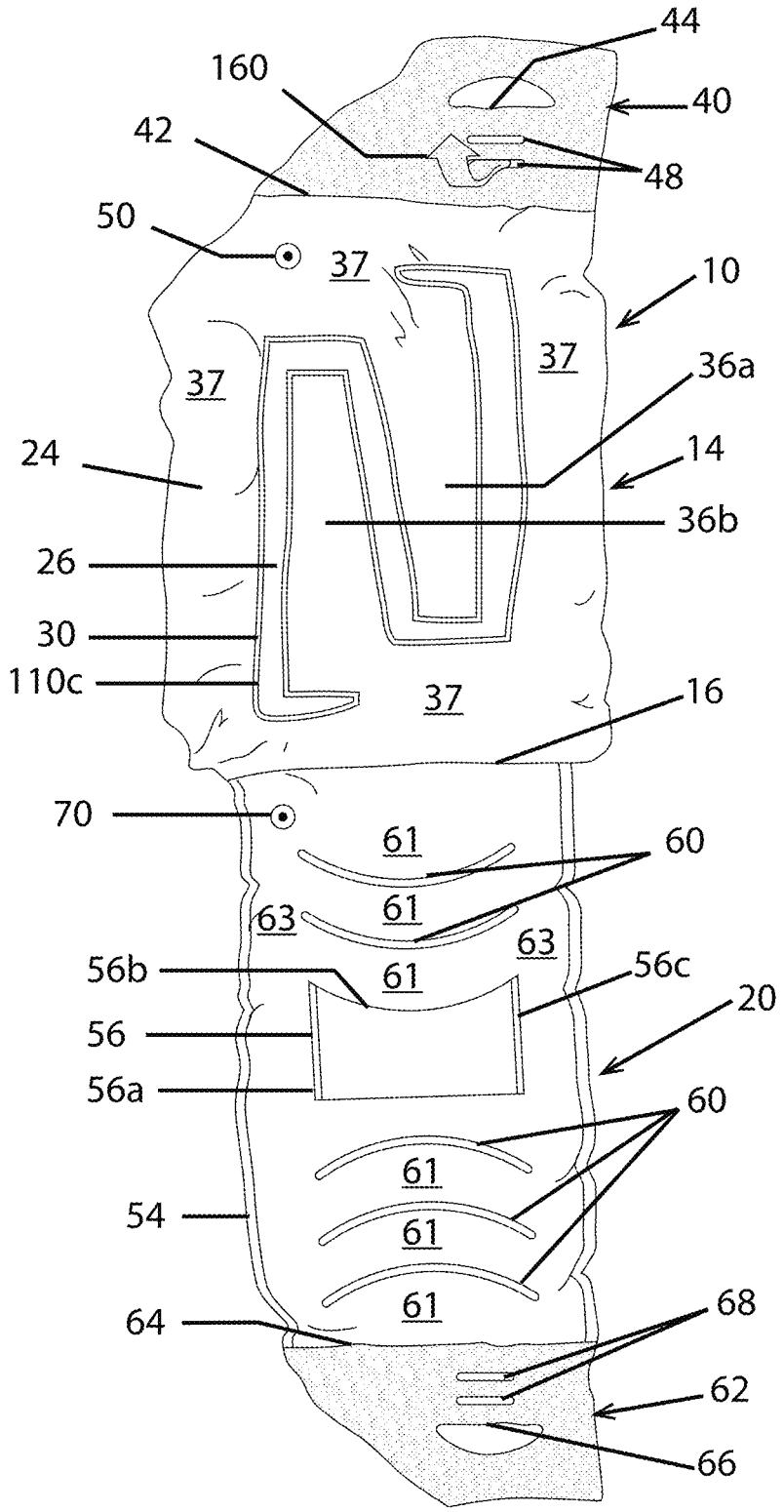
FIG. 1 is a plan view of a pack according to an exemplary embodiment of the invention.

While this invention is susceptible to embodiment n many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a pack 10 according to an exemplary embodiment of the present invention. The pack 10 includes a shoe-carrying body 14 connected by a living hinge 16 to an inflatable top cover 20.

The body 14 includes an inflatable base wall 24 formed by a top web 110 and a bottom web 116 (FIG. 2) sealed together as described below, and an inflatable bottom cover 26 formed by the top web 110 and the bottom web 116 sealed together as described below. The base wall 24 includes a substantially Z-shaped gap 30 which partially defines opposing shoe inserts or bladders 36*a*, 36*b* and peripheral air cells or air cushions 37.

A first end tab 40 extends from the base wall 24, and the bottom cover 26 along a line 42. A hand hole 44 is formed through the end tab 40. One or more closure slits 48 are also formed through the end tab 40. An air valve 50 on and through the top web 110 allows for the inflation of the base wall 24.

Figure 2:
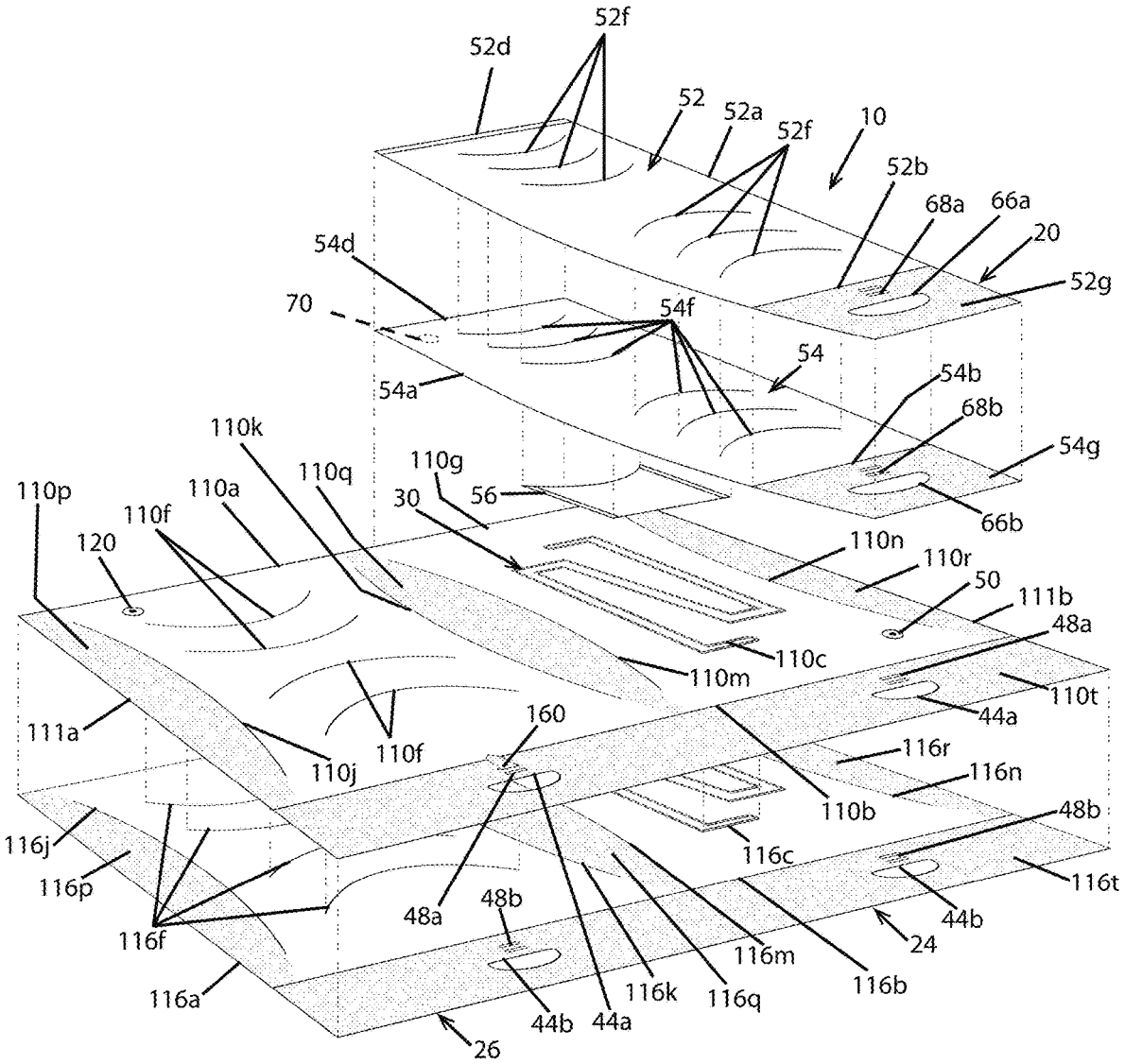
FIG. 2 is an exploded perspective view of the layers of construction of the pack shown in FIG. 1.

The top cover 20 is formed by a top web 52 and a bottom web 54 (FIG. 2). The cover 20 includes a pocket 56 sealed around three edges 56*a*, 56*b*, 56*c* to the bottom web 54, and a plurality of seams 60. The seams create rows of air cells or air cushions 61 and side air cells or cushions 63, within the cover.

A second end tab 62 extends from the cover 20 along a line 64. A hand hole 66 is formed through the end tab 62. One or more closure slits 68 are also formed through the end tab 62. An air valve 70 on and through the bottom web 54 allows for the inflation of the cover 20.

FIG. 2 illustrates the construction of the pack 10. Selective sealing between the top web 110 and the bottom web 116 forms the base wall 24 and the bottom cover 26 in side-by-side orientation. Seams can be formed by plastic welding or sonically welding, such as by a 2 cm wide airtight seam, or by being otherwise attached. Other interface areas between the top web 110 and the bottom web 116 are fused together, by heat, adhesive or other means as shown by the shaded patterns in FIG. 2.

Figure 8:
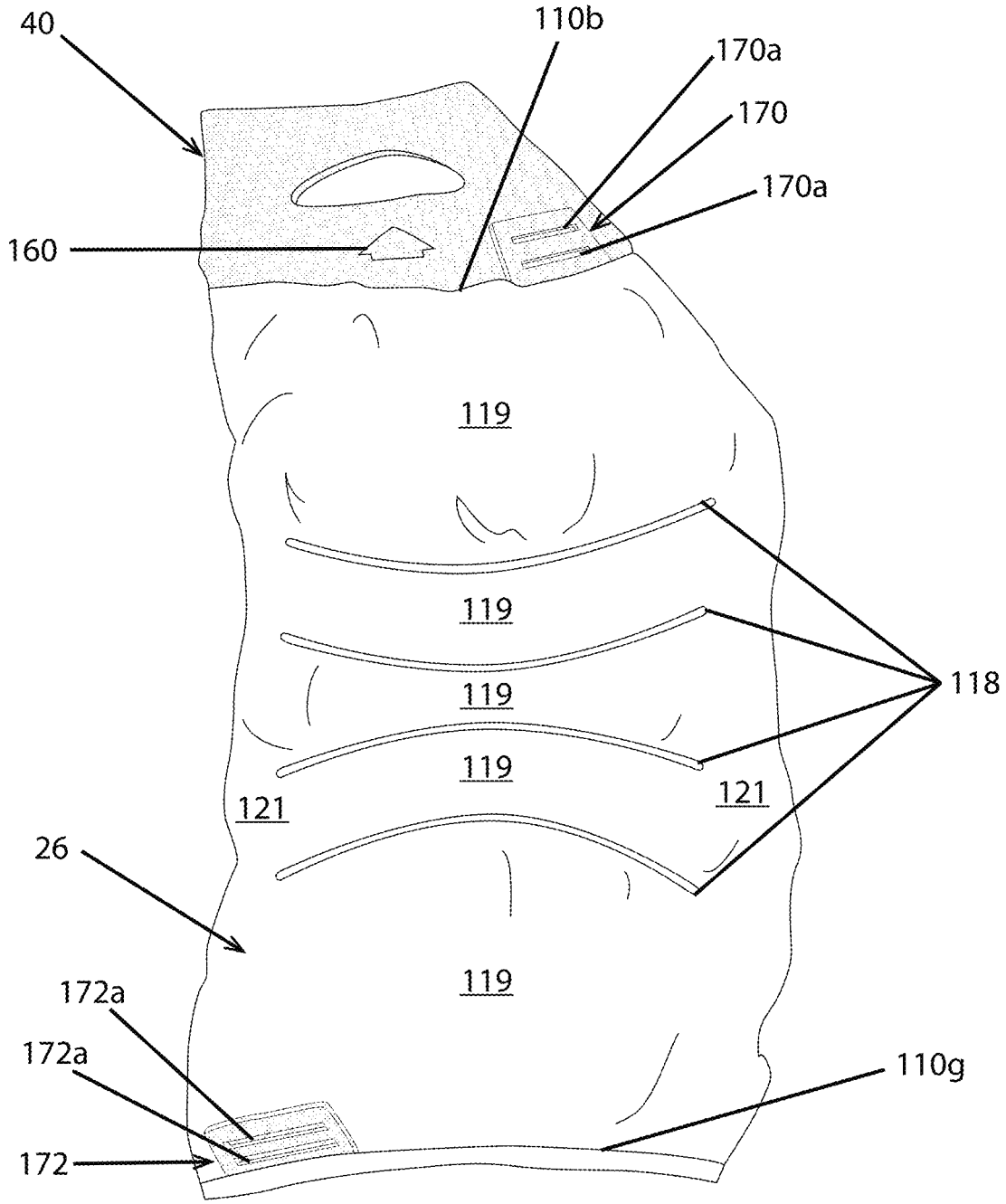
FIG. 8 is a rear view of the pack shown in FIG. 7.

The webs 110, 116 are plastic welded, or sonically welded, such as by a 2 cm wide airtight seam, or otherwise attached around their rectangular perimeters 110*a*, 116*a*. Additionally, the top web 110 and the bottom web 116 are plastic welded or sonically welded, such as by a 2 cm wide airtight seam, or otherwise attached together along intermediate lines 110*b*, 116*b*. The top web 110 and the bottom web 116 are further plastic welded or sonically welded, such as by a 2 cm wide airtight seam, or otherwise attached around a Z-shape perimeter 110*c*, 116*c* to form the gap 30 and the bladders 36*a*, 36*b*. The top web 110 and the bottom web 116 are also plastic welded or sonically welded, such as by 2 cm wide airtight seams, or otherwise attached together along plural arcuate lines 110*f*, 116*f* to form seams 118 (FIG. 8). The seams 118 form rows of air cells or air cushions 119 (FIG. 8), and side air cells or cushions 121 (FIG. 8), within the bottom cover 26.

The top web 110 and the bottom web 116 are further plastic welded or sonically welded, such as by 2 cm wide airtight seams, or otherwise attached together along arcuate lines 110*j*, 116*j*; 110*k*, 116*k*; 110*m*, 116*m*; 110*n*, 116*n*. The top web 110 and the bottom web 116 are further fused together by heat, or by adhesive or otherwise secured within the shaded areas or bands 110*p*, 116*p*; 110*q*, 116*q*; 110*r*, 116*r*; and 110*t*, 116*t*.

Figure 3:
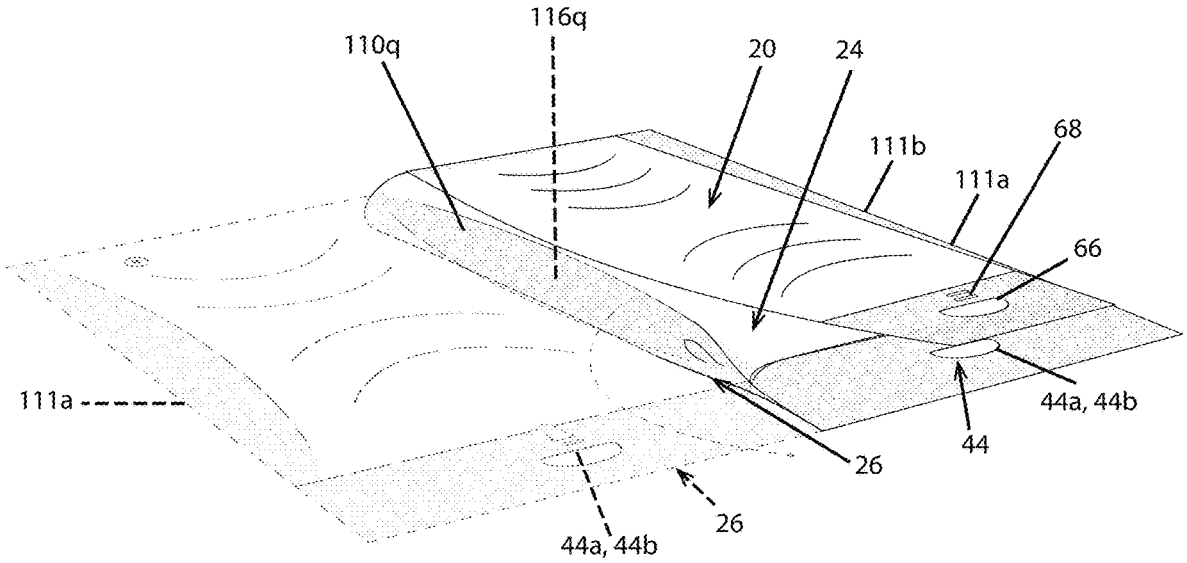
FIG. 3 is a perspective view of the pack shown in FIG. 2 showing a further assembly step.

The hand hole 44 is formed by two spaced-apart hand holes 44*a* through the top web 110, and two spaced-apart hand holes 44*b* through the bottom web 116. As illustrated in FIG. 3, when the pack is assembled, the hand holes 44*a*, 44*b* all register to form the single hand hole 44, four layers thick.

Similarly, the closure slits 48 are formed by identical closure slits 48*a*, 48*b* formed in the top web 110 and the bottom web 116 respectively which, when the pack is assembled, register to form a single grouping of closure slits 48. An inflation valve 120 is provided in the top web 110 near an edge of the top web 110 opposite to an edge near the air valve 50.

Figure 6:
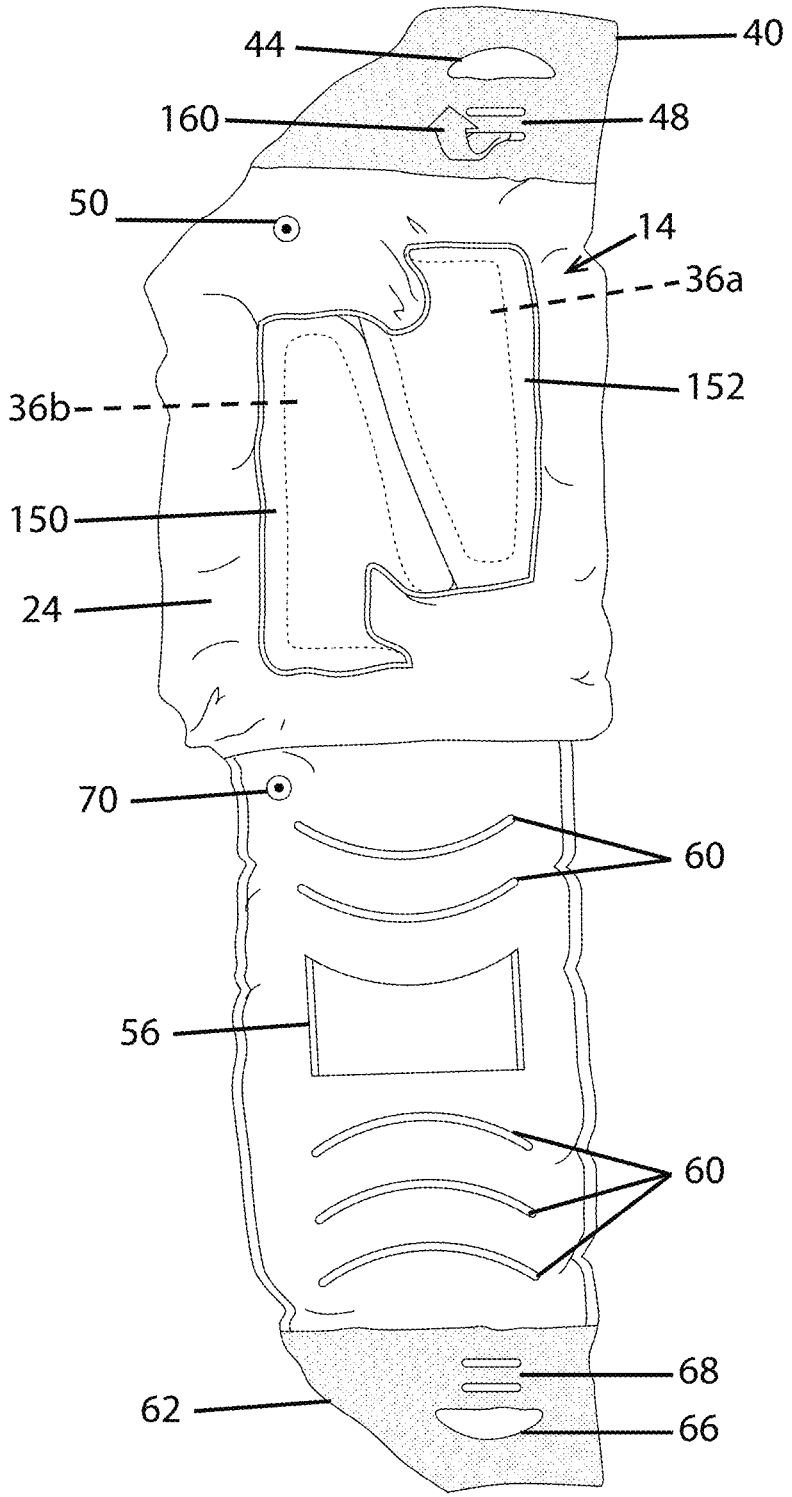
FIG. 6 is a plan view of the pack shown in FIG. 1 with shoes installed.

The cover 20 is constructed of the top web 52 and the bottom web 54. The webs 52, 54 are plastic welded or sonically welded, such as by a 2 cm wide airtight seam, or otherwise attached together around their perimeters 52*a*, 54*a* and also across intermediate lines 52*b*, 54*b*. An end line 52*d*, 54*d* is also welded to an end line 110*g* of the webs 110, 116. The remaining portions of the perimeters 52*a*, 54*a* are not secured to the underlining web 110 so that the cover chamber 20 can be folded toward or away from the web 110 about the line defined by 52*d*, 54*d*, 110*g*, as shown in FIG. 1. Plural arcuate lines 52*f* are plastic welded or sonically welded, such as by a 2 cm wide airtight seam, or otherwise attached together to underlying arcuate lines 54*f* to create the seams 60 (FIG. 6).

Hand holes 66*a*, 66*b* are in registry to form the single hand hole 66 when the area 52*g* is fused together by heat, or by adhesive or otherwise secured to the area 54*g*. Closure slits 68*a*, 68*b* are in registry to form the single group of slits 68 when the area 52*g* is fused together by heat, or by adhesive or otherwise secured to the area 54*g*.

FIG. 3 illustrates that after the construction demonstrated in FIG. 2 has been performed, the bottom cover 26 is folded under the base wall 24 about the region 110*q*, 116*q*. The regions 110*p*, 116*p* and the region 110*r*, 116*r* are welded together along their outer side edges 111*a*, 111*b* and the regions 110*t*, 116*t* are folded in half and secured or fused together forming the tab 40. The cover 20 can be folded about the line 52*d* onto the base wall 24 and the hand holes 44, 66 are in registry for the user to insert his hand and carry the entire closed pack 10.

Figure 4:
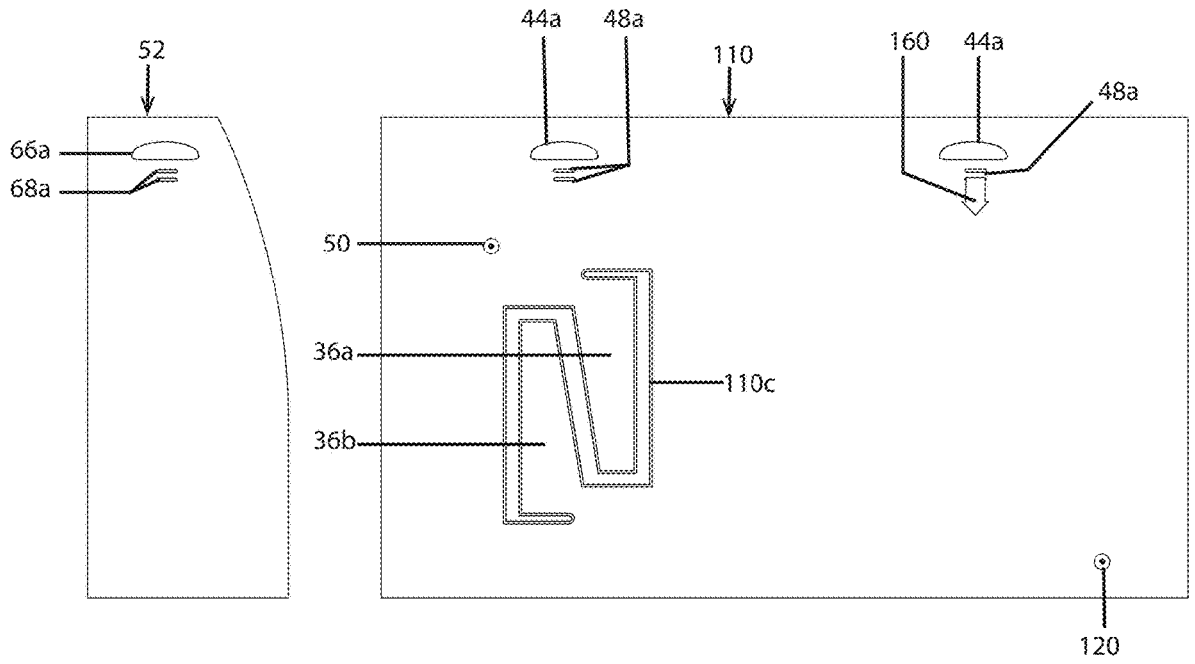
FIG. 4 is an exploded plan view showing a top panel of a top cover and a first layer of the pack shown in FIG. 2.
Figure 5:
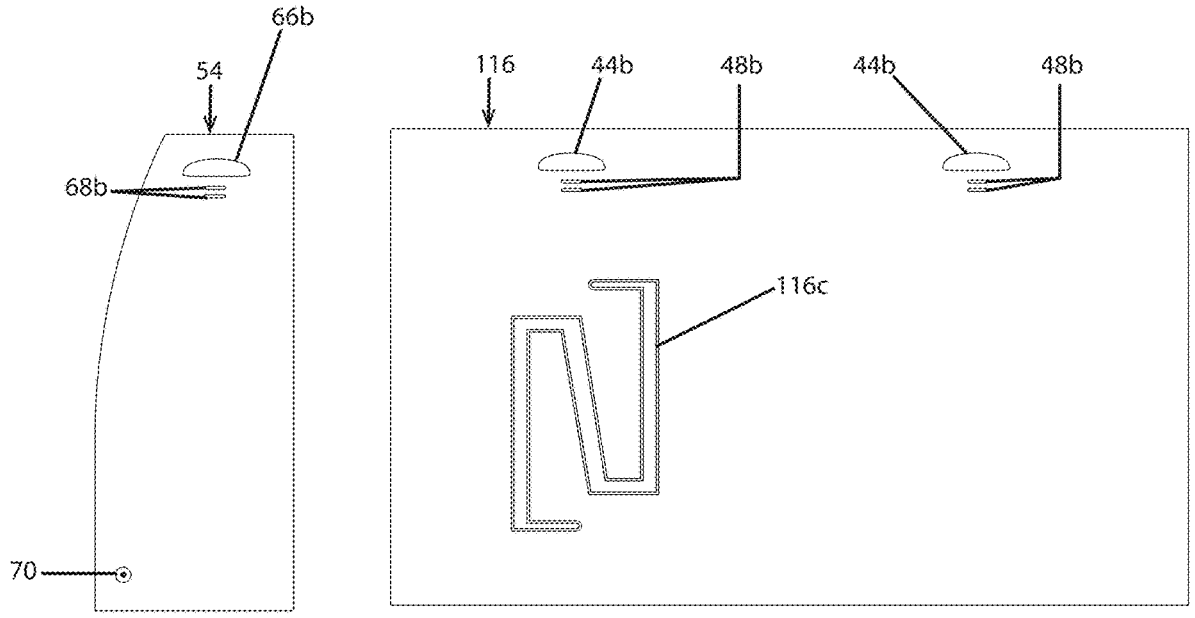
FIG. 5 is an exploded plan view showing a bottom panel of the top cover and a second layer of the pack shown in FIG. 2.

FIGS. 4 and 5 show stock material with cutouts for use in assembling the webs 110, 116 and 52, 54 shown in FIG. 3. The hand holes, the closure slits and the Z-shaped gap can be laser cut through the webs 52, 54, 110, 116.

FIG. 6 illustrates the pack 10 of FIG. 1 with the cover 20 pivoted open from the body 14 and two shoes 150, 152 installed onto the body 14 with the bladders 36*a*, 36*b* inserted into the shoes. Each shoe should be placed partially inside of the slot with the toe of the shoes facing opposite each other and the soles of the shoe facing away from each other. The base wall 24 can be initially deflated to assist in fitting the bladders 36*a*, 36*b* into the shoes. The shoes can be installed with the bladders 36*a*, 36*b* inserted into the shoes and then the base wall 24 can be inflated. If the bottom cover 26 and the top cover 20 are deflated at this stage, they can both now be inflated to complete the pack. A back side of the shoes (not shown in FIG. 6) is protected by the bottom cover 26, an inside of each shoe is filled by one of the bladders 36*a*, 36*b*, and once the top cover 20 is folded over on top of the shoes 150, 152, the sides of the shoes visible in FIG. 6 will be protected as well.

Figure 7:
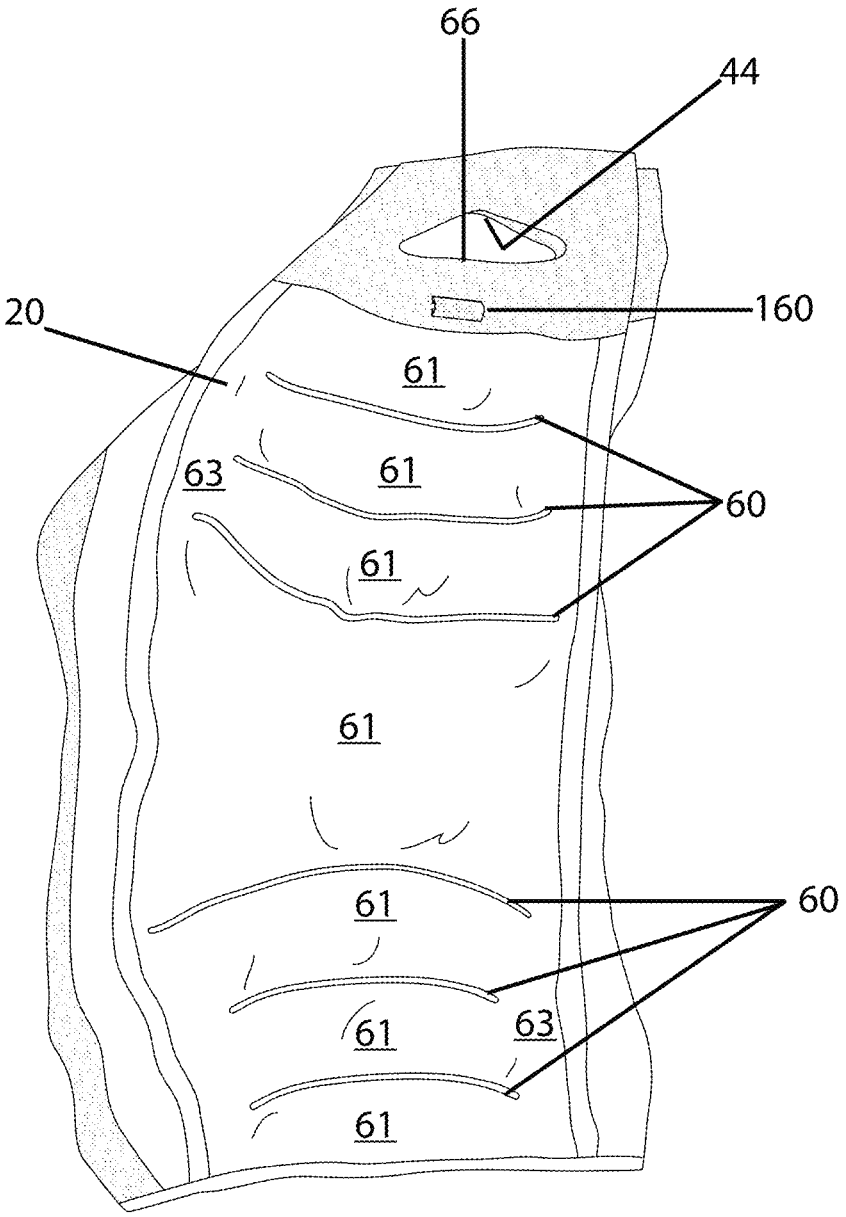
FIG. 7 is an elevation view of the pack shown in FIG. 6 after being folded and held in a vertical orientation.

FIG. 7 illustrates a front side of the pack when oriented vertically, in a folded and closed condition, wherein a strap or ligature 160 has been inserted through the closure slits 68, 48 to keep the pack in a closed condition.

Figure 9:
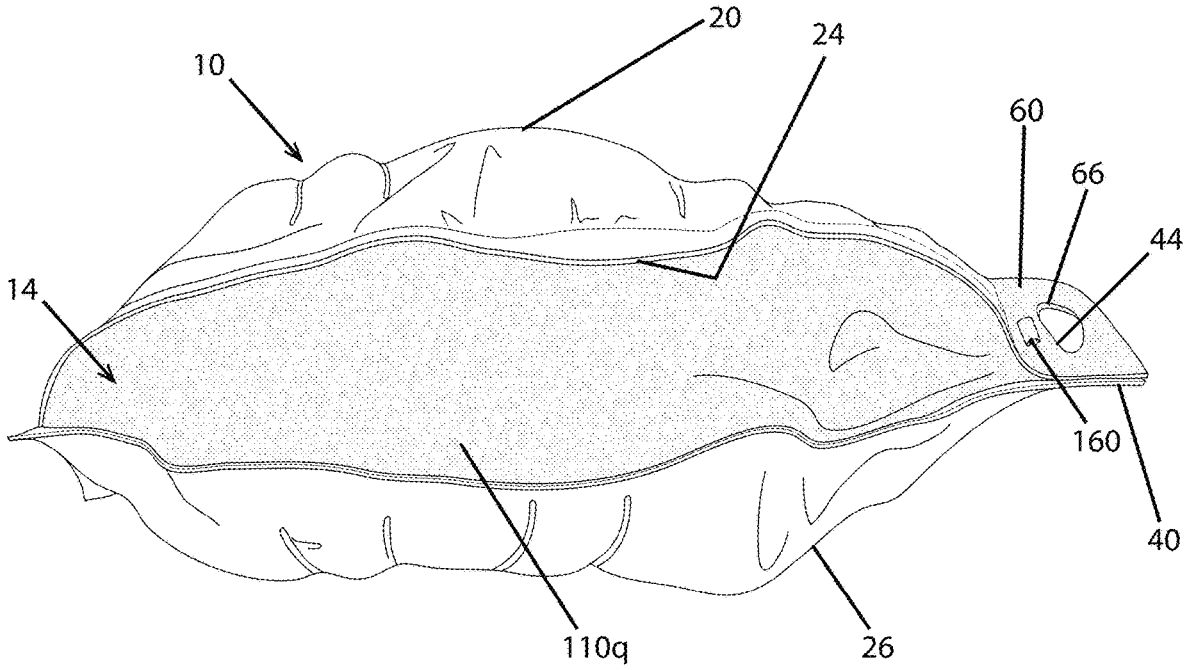
FIG. 9 is a side perspective view of the pack in a horizontal orientation shown in FIG. 8.

FIG. 8 illustrates a backside of the pack when oriented vertically, and including a further enhancement wherein upper and lower strap retainers 170, 172 are plastic welded or sonically welded, such as by a 2 cm wide airtight seam, or otherwise attached along the weld lines 110*g*, 110*b* for use with a carrying strap to carry the pack 10 in a backpack manner, FIG. 9 illustrates the pack 10, inflated with the cover 20 folded over onto the shoe holding body 14.

Figure 10:
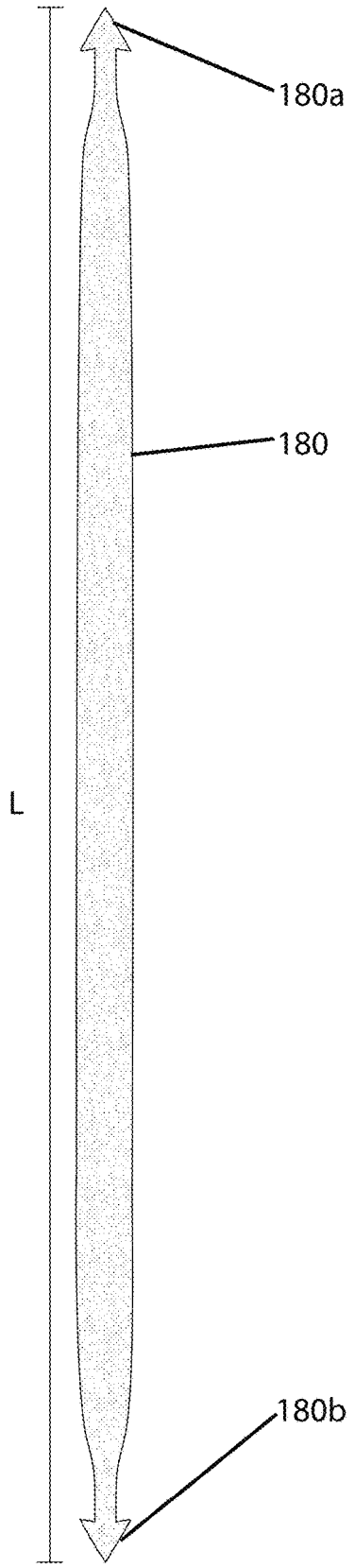
FIG. 10 is an elevation view of a removable carrying strap for use with the pack shown in FIG. 8.

FIG. 10 illustrates a strap 180 that can be used to connect the upper and lower strap retainers 170, 172 to carry the pack on a user's back or shoulder. The strap is designed with an arrowhead 180*a*, 180*b* on each end, so as to lock the protruding corners into slits 170*a*, 172*a* of the strap retainers 170, 172 (FIG. 8), which are positioned diagonally on the back of the pack. The strap 180 can have a length L of about 38 inches.

Figure 11:
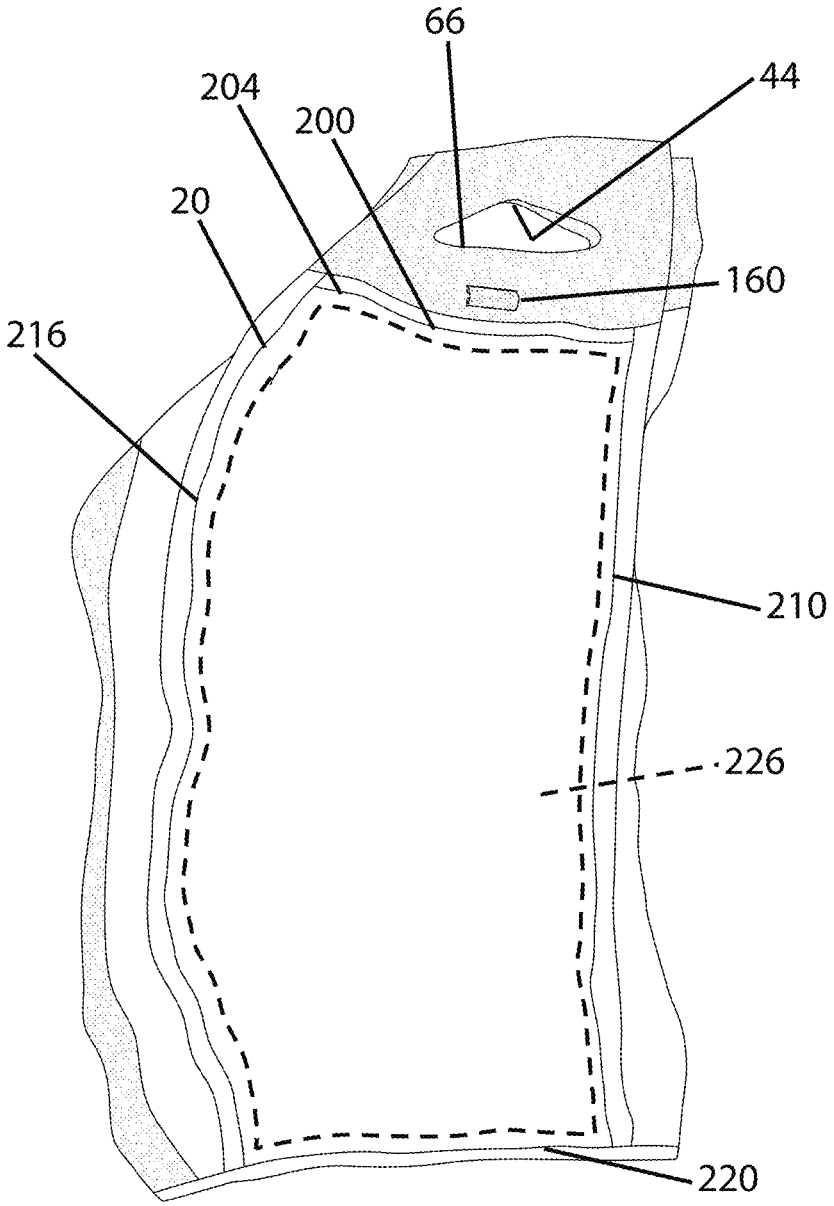
FIG. 11 is an elevation view of the pack shown in FIG. 7 with an added pocket after being folded and held in a vertical orientation.

FIG. 11 illustrates a further enhancement wherein a pocket 200 is attached to an exposed front surface of the front cover 20. The pocket 200 has an unsecured top edge 204, right and left sides 210, 216 secured to the cover 20 and a bottom edge 220 secured to the cover 20, A card 226 being substantially rigid is slipped into the pocket 200 to provide for additional protection to the cover 20 and the package 10. A similar pocket and card can be alternatively or additionally provided on the back cover 26.

According to the exemplary embodiments, the webs 110, 116 and 54, 56 are composed of a plastic such as HDPE, PET, LDPE, or other plastic, and preferably recycled plastic. The thickness of the webs can be 300-500 gauge (3-5 mil).

Examples of how it Will be Used

Although the exemplary pack described herein is advantageously used for packaging shoes, other embodiment can be used to cushion and support other items requiring protection during storage and transport, such as books, electronic devices, food/beverage products, apparel/accessory products. The shape of the base wall 24 will be configured to fit the shape of the item to be protected.

Additionally, the ability of the pack to create a circular economic model, allowing the pack to be reused at a low cost to the manufacturer, is advantageous to reduce packaging waste.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A package for an article, comprising:

a base wall, the base wall including two layers that are connected together to form a first sealed air space therebetween, the two layers shaped to form a gap and a pair of protruding portions defining a portion of the gap, the gap substantially Z-shaped to hold a pair of shoes therein with the pair of protruding portions arranged and shaped to fit into a pair of shoes arranged facing each other with toe portions of the pair of shoes facing in opposite directions, wherein the first sealed air space is inflatable such that the pair of protruding portions fill portions of the inside volumes of said pair of shoes.

2. The package of claim 1, further comprising a back cover connected to the base wall and comprising two layers that are connected together to form a second sealed air space therebetween, wherein the back cover overlies the gap and the second sealed air space is inflatable to protect a first surface of each of the pair of shoes exposed in the gap.

3. The package of claim 2, further comprising a front cover connectable to the base wall, wherein the front cover comprises two layers connected together to form a third sealed air space therebetween, wherein when the third sealed air space is inflated and the front cover is positioned over the gap on a side opposite the back cover, a second surface of each of the pair of shoes opposite the first surface is protected.

4. The package of claim 3, wherein the front cover is hinged to the base wall, to be alternately aligned to cover or reveal the pair of shoes held in the gap in the base wall.

5. The package of claim 3, comprising an air valve on the back cover to allow for inflation and deflation of the back cover.

6. The package of claim 3, comprising a handle connected to the base wall for carrying the package.

7. The package of claim 3, wherein the front cover is hinged at a first position to the base wall, to be selectively pivoted to cover or reveal the pair of shoes held in the gap in the base wall, and wherein the front cover is selectively secured at a second position by a fastening device to the base wall, and the package includes a handle connected to the base wall for carrying the package in a closed configuration.

8. The package of claim 3, wherein at least one of said front cover and said back cover are composed of clear flexible material for easy visibility of the article inside the package.

9. The package of claim 3, wherein one of said front cover and said back cover comprises a pocket which covers a height of the package and has an open interior wherein a more rigid card can be slipped into and out of said pocket, serving as a reinforced cover for said package.

10. The package of claim 3, comprising an air valve on the front cover to allow for inflation and deflation of the front cover.

11. The package of claim 3, further comprising a pocket on the front cover.

12. The package of claim 3, wherein the front cover, the back cover and the base wall are configured to have a flat profile when not inflated.

13. The package of claim 1, comprising an air valve on the base wall to allow for inflation and deflation of the base wall.

14. The package of claim 1, comprising a pocket on an interior or an exterior of the package.

15. The package of claim 1, comprising covers located over both sides of the base wall, at least one of the covers openable to expose the gap in the base wall.

16. The package according to claim 15, wherein at least one of the covers is inflatable.

17. The package according to claim 16, wherein at least one of the covers includes an exterior pocket.

18. The package according to claim 16, wherein at least one of the covers includes an interior pocket.

* * * * *